United States Patent [19]

Ginzburg

[11] Patent Number: 4,793,169

[45] Date of Patent: Dec. 27, 1988

[54] CONTINUOUS BACKPASS ROLLING MILL

[75] Inventor: Vladimir B. Ginzburg, Pittsburgh, Pa.

[73] Assignee: United Engineering, Inc., Pittsburgh, Pa.

[21] Appl. No.: 879,369

[22] Filed: Jun. 27, 1986

[51] Int. Cl.[4] ..... B21B 31/20

[52] U.S. Cl. ..... 72/240; 29/527.7; 72/229; 72/365

[58] Field of Search ..... 72/240, 241, 199, 229, 72/231, 365, 366, 252; 29/527.7

[56] References Cited

U.S. PATENT DOCUMENTS

| | | | |
|---|---|---|---|
| 3,385,077 | 12/1969 | Wilson | 72/229 |
| 3,896,653 | 7/1975 | Sakai et al. | 72/365 |
| 4,608,850 | 9/1986 | Ballantyne et al. | 72/240 |
| 4,630,352 | 12/1986 | Ginzburg et al. | 29/527.7 |
| 4,675,974 | 6/1987 | Connolly | 72/229 |

FOREIGN PATENT DOCUMENTS

| | | | |
|---|---|---|---|
| 58-100904 | 6/1983 | Japan | 29/527.7 |

*Primary Examiner*—W. Donald Bray

*Attorney, Agent, or Firm*—Kirkpatrick & Lockhart

[57] ABSTRACT

A method for hot rolling a continuously cast thin slab to form strip comprising the steps of: (a) subjecting a segment of predetermined length of the slab to a reduction pass in a first direction between a pair of work rolls; (b) retracting the segment in a direction opposite the first direction to the entrance side of the work rolls while accommodating the additional length of the segment produced by the reduction operation; (c) repeating steps (a) and (b) in sequence as necessary to finish the segment; and (d) consecutively subjecting the next contiguous portion of the slab to steps (a), (b) and (c) until the slab is finished along its entire length. Apparatus for practicing the method also is disclosed.

9 Claims, 8 Drawing Sheets

Pass No. 1'

Back Pass No. 1'

Pass No. 2'

Back Pass No. 2'

Pass No. 3'

Pass No. 1"

CONTINUOUS BACKPASS ROLLING MILL

BACKGROUND OF THE INVENTION

1. Field of the Invention

This invention relates to a method of rolling an elongated metal preform, such as a continuously cast thin slab, to form strip; more particularly, to a method for finish rolling contiguous segments of the elongated preform in a single rolling mill stand.

2. Description of the Prior Art

Since the advent of the continuous casting of molten metals, workers in the art have sought ways to process the continuous strand of solidified metal in an "in-line" manner to produce useful, finished metal products with as few interruptions and ancillary processing steps as possible. An example of these development efforts may be found in the production of hot rolled steel strip.

Continuously cast slabs had earlier been the starting material for hot rolled strip products; these slabs had to be heated to rolling temperature and then subjected to a two stage rolling process. The first stage involved preliminary reduction in a series of strong roughing stands for rolling the relatively thick slabs; then the material was finished in a string of final rolling stands. Obviously, the cost of the equipment and indoor space required for this two stage rolling of hot strip makes the procedure unattractive.

In order to eliminate the need for roughing stands, having a thickness in the range of about ¾" to 1.5" and a width ranging up to about 60 inches. The thin slab can be hot rolled directly into strip products, thereby eliminating the production of conventional slabs and their associated preliminary rolling. But with this advance came a new series of problems brought about by the fact that maximum casting speed at which the thin slab leaves the continuous casting machine is much lower than the minimum possible rolling speed of conventional hot rolling mills. Workers in the art compensated for the differential in casting and rolling speeds by shearing the thin slab to form discrete elongated pieces which were coiled and held for subsequent hot rolling at the higher speeds in mills such as tandem finishing mills having 5 to 6 stands in series; reversing mills such as the Steckel mill that requires elaborate coil heating furnaces at both ends; and planetary mills which produce a scalloped surface on the rolled material, thereby making necessary a flattening pass through an additional roll stand. All of these known finishing mills are costly and require considerable maintenance.

The present invention, as applied to hot rolling, accepts the relatively slow speeds of production from the thin slab casting machine and seeks to match the hot rolling speed with them. This technique permits the use of a relatively simple, inexpensive single mill stand. The space required for the practice of the present invention is small compared with known hot strip plants.

Thus, in one embodiment of the present invention, the strand of thin slab from the continuous caster can be processed through the hot rolling mill without interruption. The invention also may be used advantageously to hot or cold roll discrete coils of thin metal slab; further billets or shapes having curved cross sections such as rounds and ovals may be rolled by the practice of the present invention.

SUMMARY OF THE INVENTION

The present invention provides a method for rolling an elongated metal product to form strip comprising the steps of: (a) subjecting a first segment of predetermine length of the metal product, that length being substantially less than the total length of the elongated slab, to a reduction pass in a first direction between a pair of work rolls, the reduction pass having a first phase in which a leading portion of the first segment is rolled to finish thickness and a second phase in which a trailing portion of the first segment is rolled to a thickness greater than finish thickness; (b) reversing the direction of movement of the first segment to bring the leading edge of the trailing portion to the entry side of the work rolls while accommodating the additional length of the trailing portion produced by the reduction pass; (c) repeating step (a) with respect to the trailing portion and a next contiguous predetermined length of the elongated metal product which together form a second segment; (d) repeating step (b) with respect to the second segment; and (e) repeating steps (a) and (b) in sequence with respect to consecutive segments of the elongated metal product formed in accordance with step (c). If desired, at least a portion of the metal product segment may be subjected to a reduction operation by the work rolls during the performance of step (b).

The elongated metal product preferably used as the starting material in the present invention is a thin, elongated slab; however, the metal product also may be a billet or a shape having a curved cross section such as a round or an oval.

The method of the present invention advantageously may be used to produce a continuous elongated metal strip-like product by an in-line casting and rolling process comprising the steps of: (a) in a casting machine, producing a continuous elongated metal strip-like product having a thickness greater than a desired thickness, the cast product having a desired exit speed and a continuous movement away from the machine; (b) hot rolling the cast product in a rolling mill while the product is moving away from the casting machine by reducing only a first predetermined length of the cast product to a thickness greater than the desired thickness, the length being less than the total length of the cast product; (c) after the predetermined length is rolled and while the portion of the cast product between the casting machine and the rolling mill continues to move towards the mill, causing the rolled length to be positioned at the entry side of the rolling mill; (d) during the repositioned step, looping the product between the casting machine and the mill in a manner to prevent interruption of the continuous issuance of cast product from the casting machine; (e) causing the partially reduced length to reenter the rolling mill together with the next contiguous predetermined length of the cast product and performing a further reduction on the first predetermined length and a first reduction of the next predetermined length; and thereafter (f) repeating in sequence steps (c), (d) and (e) as to each next predetermined length of the cast product.

The invention may also include apparatus for the production of an elongated metal strip-like product comprising: a continuous casting machine for producing and issuing an elongated slab having a thickness greater than the desired thickness of the strip-like product; a rolling mill stand; means for feeding the slab issuing from the casting machine to the entry side of the rolling mill stand; means for intermittently positioning predetermined, partially rolled lengths of the slab on the entry side of the rolling mill stand for further rolling, thereby producing an additional length of slab between the casting machine and the rolling mill stand; and means disposed between the casting machine and the rolling mill stand for selectively deflecting the slab from its normal path to accommodate the additional length and thereby to prevent interruption of the issuance of the slab from the casting machine.

Other details and advantages of the present invention will become apparent from the following detailed description taken with the accompanying drawings in which:

DESCRIPTION OF THE PREFERRED EMBODIMENTS

Figure 1:
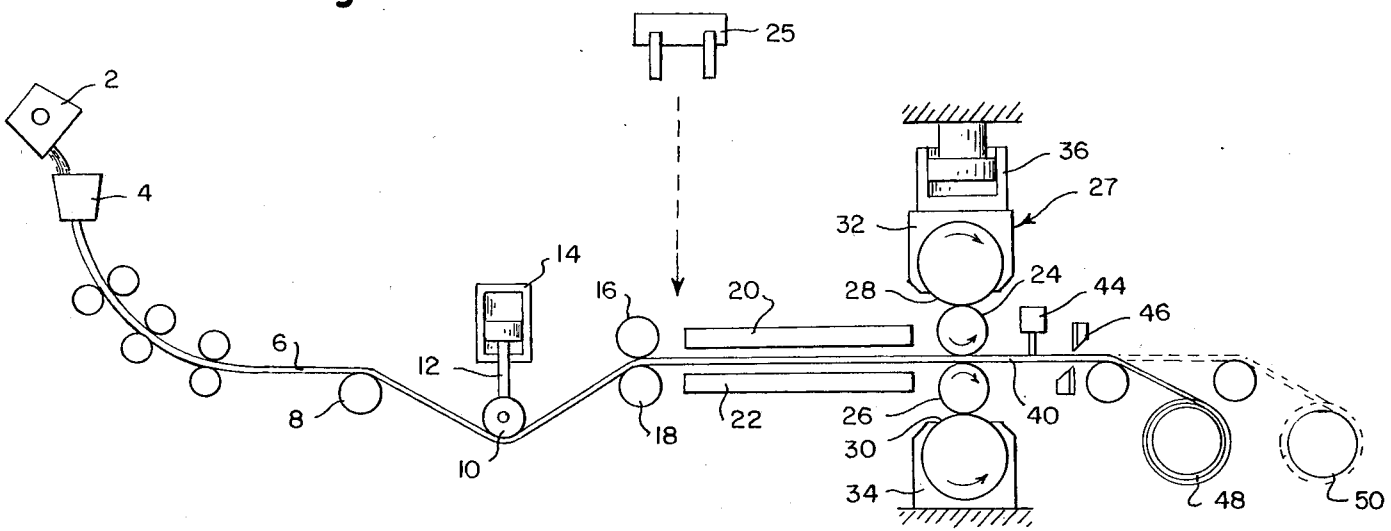
FIG. 1 is a diagrammatic showing of the major components of a plant in which the present invention may be practiced.
Figure 2:
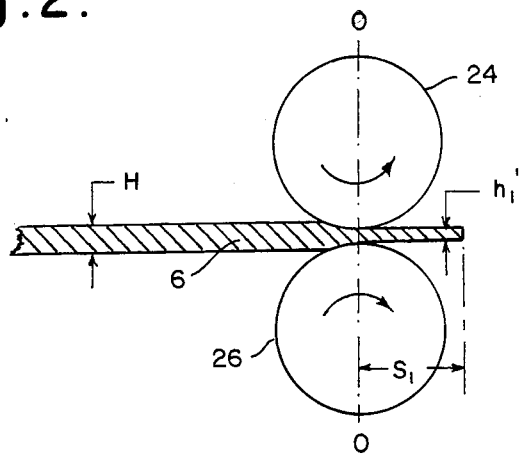
FIGS. 2–7 are a series of diagrams illustrating the roll used in one form of the invention.
Figure 3:
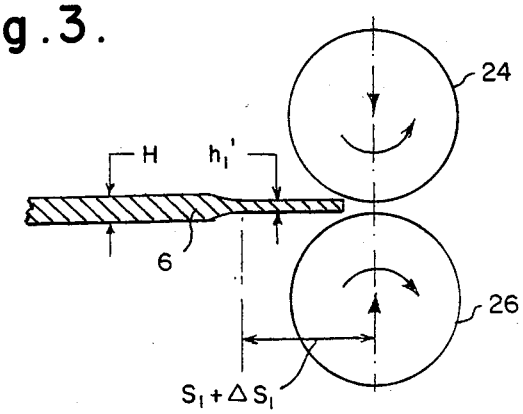
Figure 4:
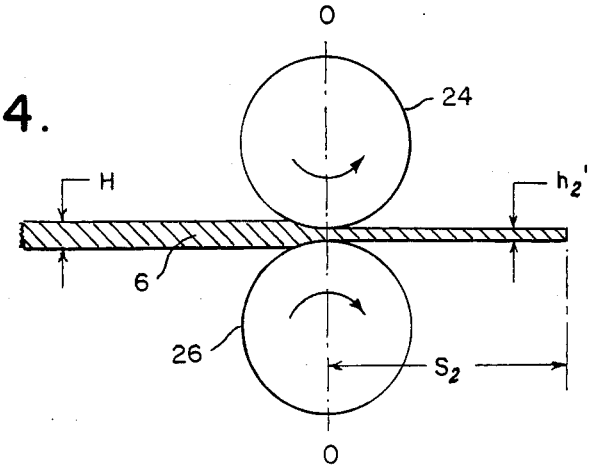
Figure 5:
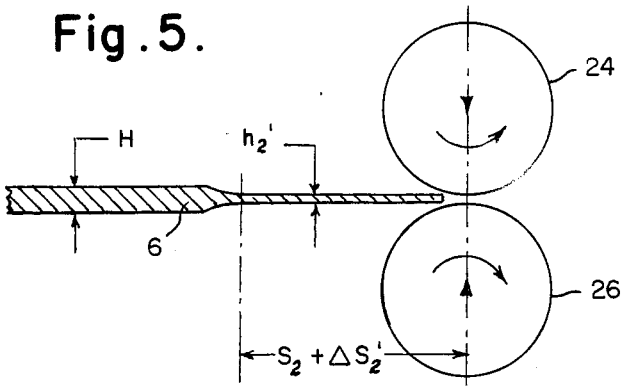
Figure 6:
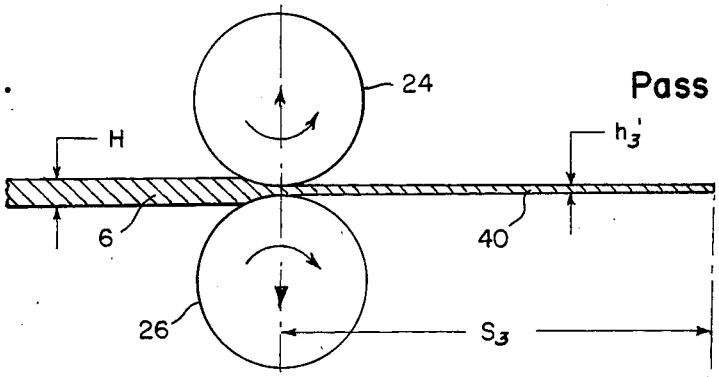

Referring to the drawings, FIG. 1 diagrammatically depicts the equipment components and sequence of operations that may be used in connection with the practice of one embodiment of the method of the present invention. Starting at the left side of FIG. 1, molten metal, which may be either ferrous or nonferrous, is poured from ladle 2 into a continuous casting machine generally designated by the reference numeral 4. A continuously cast thin slab 6, having a thickness in the range of about 0.75" to 1.5" and a width in the range of about 8" to 60", leaves continuous caster 4, passes over bending roll 8, under roll 10 attached to the extended piston rod 12 of holddown cylinder 14, between deflector pinch roll 16 and bending roll 18, through upper and lower induction heaters 20 and 22, respectively, and into the bite of work rolls 24, 26. A hydraulic forging press, schematically shown in FIG. 1 and designated 25, may be moved into position between deflector pinch roll 16 and induction heaters 20, 22 to form the leading edge of thin slab 6 for purposes explained hereinafter.

Before the leading edge of thin slab 6 is placed into the bite of work rolls 24, 26 for the first forward pass, it is necessary to form a loop in the slab 6 (as shown in FIG. 1). This additional length of slab 6 is needed because the speed of work rolls 24, 26 causes slab 6 to move forwardly much faster than the relatively slow speed at which slab 6 issues from continuous caster 4.

A back pass mill stand, generally designated by the reference numeral 27, is used in practicing the method of the present invention. Work rolls 24, 26 or their respective back-up rolls 28, 30, which are mounted in back-up roll chucks 32, 34, or both, are driven by suitable motors (not shown). The gap between work rolls 24, 26 is adjusted by force cylinder 36. The finished strip, generally designated by the reference numeral 40, produced by the practice of the method of the present invention within mill stand 27 is cooled by water sprays from coolant header 44 and sheared by shear 46 after suitable lengths of strip 40 are alternately wound on down-coilers 48, 50.

Figure 7:
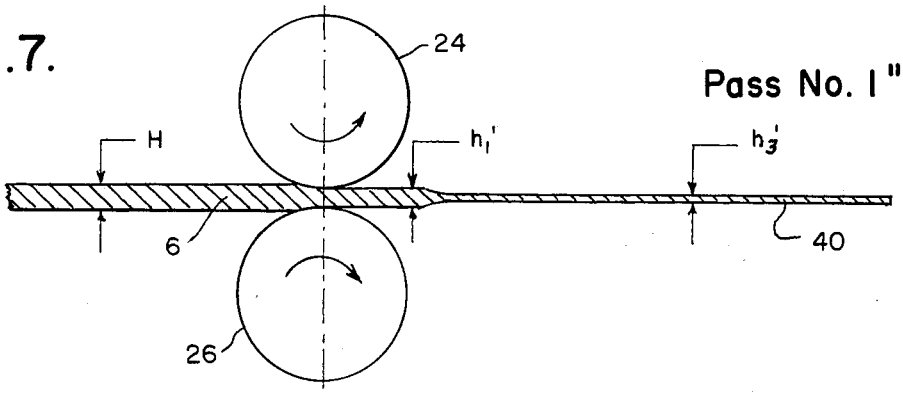

One embodiment of the present invention will now be described by reference to FIGS. 2–7 and occasional reference to FIG. 1. Where appropriate, like components in those Figures will be referred to with like reference numerals. Generally, FIGS. 2–7 depict the operation of work rolls 24, 26 on a segment of continuously cast thin slab 6. FIGS. 2–7 illustrate one complete cycle of the method of the present invention performed on that segment; the cycle consists of three straight passes, labeled PASS #1', PASS #2', and PASS #3', and two back passes, labeled BACK PASS #1' and BACK PASS #2'. The commencement of a new cycle on the next contiguous portion of thin slab 6 is illustrated in FIG. 7 and is labeled PASS #1". In viewing FIGS. 2–7 and similar Figures discussed below, it should be borne in mind that the rolled surfaces are in some instances exaggerated in definition; i.e. flat surfaces may be shown for emphasis whereas such surfaces may be curved under actual rolling conditions.

In PASS #1' (see FIG. 2), the gap between work rolls 24, 26 is adjusted by force cylinder 36 to thickness $h'_1$. The thickness of thin slab 6 is H. A segment of slab 6 having a predetermined length is rolled in the forward direction. When the rear end of that predetermined length reaches the roll bite line O—O, the roll gap opens slightly and this action, in combination with slowing down deflector pinch roll 16 and bending roll 18, stops the movement of slab 6. The rolled segment has a length $s_1$ and has been reduced in thickness to $h_1'$ by passage through the constant roll gap of that dimension; PASS #1' is complete.

In BACK PASS #1' (see FIG. 3), slab 6 is retracted by the action of deflector pinch roll 16 and holddown cylinder 14 (see FIG. 1) until the leading edge of slab 6 is at the entry side of work rolls 24, 26. Because no reduction takes place during BACK PASS #1' (the work rolls 24, 26 keep rotating in the forward direction), the thickness of the rolled segment remains at $h_1'$; however, the retracted length $s_1+\Delta s_1$ of slab 6 is taken up in the looping of slab 6 by the downward stroke of piston rod 12 in holddown cylinder 14. Further, if slab 6 is part of a continuous strand eminating from casting machine 4, the forward movement of that strand must be accommodated in the looping of slab 6.

In PASS #2' (see FIG. 4), the roll gap is closed further to thickness $h_2'$. The segment rolled in PASS #1' is flat rolled between work rolls 24, 26 to produce a segment having a length $s_2$ and a thickness $h_2'$. Again the roll gap is opened to stop the forward movement of slab 6 and PASS #2' is complete.

In BACK PASS #2' (see FIG. 5), slab 6 is retracted a distance $s_2+\Delta s_2$ which must be taken up in the looping of slab 6. $s_2$ represents a length greater than $s_1$ because of the elongation that occurs with thickness reduction. After retraction, the roll gap is closed to a thickness $h_3'$ and PASS #3' is commenced. In PASS #3' (see FIG. 6), the segment originally rolled in PASSES #1' and #2' increases to length $s_3$ and is flat rolled to thickness $h_3'$. Length $s_3$ has now been rolled to finished thickness and is ready as strip 40 to be advanced to a downcoiler 48, 50.

At this point, PASS #3' is complete and a new contiguous segment of slab 6, having a predetermined length and thickness H, is ready to be subjected to a new cycle beginning with the roll gap set at $h_1'$ (as was the case in PASS #1'). This new cycle commences with PASS #1'' (see FIG. 7) but involves the continued forward movement of slab 6.

Figure 8:
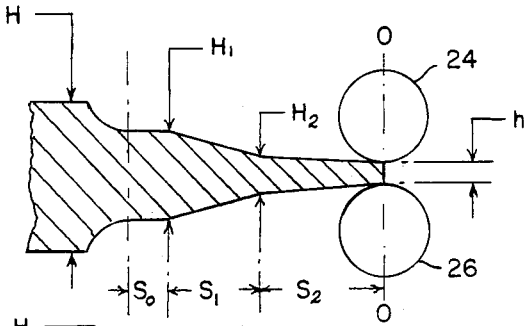
FIGS 8–12 are a series of diagrams illustrating the roll passes used in another form of the invention.

Another embodiment of the present invention will now be described by reference to FIGS. 8–12 and occasional reference to FIG. 1. This embodiment is characterized by a gradual opening of the roll gap as a forward roll pass proceeds. In FIG. 8, there is shown slab 6 which, by the action of hydraulic press 25 or other means, has had its leading edge formed to produce the profile shown. That profile includes a segment $s_2$ which tapers slightly from the leading edge (at roll bite line O'O, having thickness h, rearwardly to a thickness $H_2$; a segment $s_1$ which tapers from thickness $H_2$ to thickness $H_1$; a flat segment $s_o$; and a curved segment which transitions from thickness $H_1$ to the original thickness of thin slab 6, H.

Figure 9:
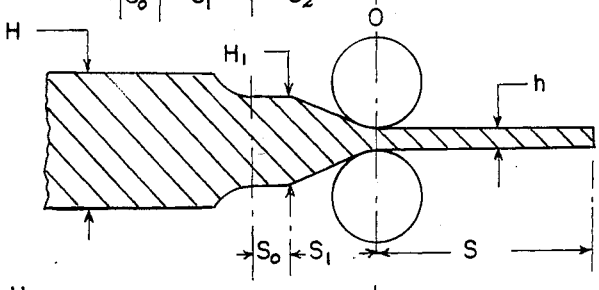
Figure 10:
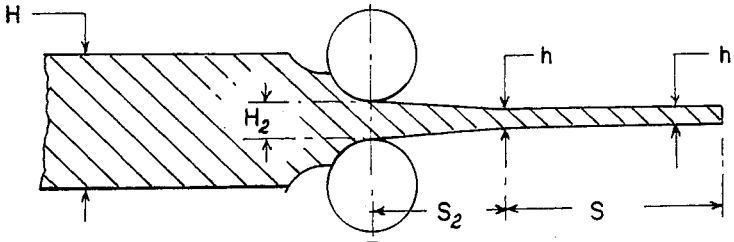
Figure 11:
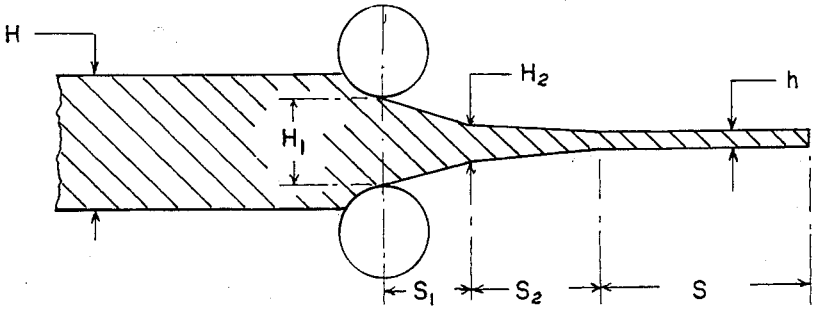

FIG. 9 illustrates the first phase of a forward pass of slab 6 through work rolls 24, 26. With the rolls set at a constant gap h, segment $s_2$ is flat-rolled to produce strip segment s at finished gauge h. The forward movement of slab 6 continues (see FIG. 10) but with work rolls 24, 26 gradually opening. Segment $s_1$ is rolled to produce a new tapered segment $s_2$ having a maximum thickness $H_2$. Further rolling (see FIG. 11) of flat segment $s_o$ produces a new steeply tapered segment $s_1$ having a maximum thickness $H_1$. Still further rolling (see FIG. 12) of the curved transition segment produces a new flat segment $s_o$ and a new curved transition segment.

Slab 6 is then retracted either by the action of deflector pinch roll 16 and holddown cylinder 14 (see FIG. 1) or by reversing work rolls 24, 26; in the latter case, some reduction may be accomplished during the back pass which ends with slab 6 in the position depicted in FIG. 8. It may be noted that section 0'—0' (the leading edge of segment $s_2$ shown in FIG. 12) has been retracted until it coincides with the roll bite line 0—0 (FIG. 8).

A new forward pass is commenced with the work rolls maintained at a constant roll gap thickness of h to roll segment $s_2$ to its finished thickness h. At that point, the forward pass continues as described above, beginning with FIG. 10. As may be seen, this embodiment of the present invention produces strip segments of finished thickness in two forward motions of slab 6 and one back pass.

In the embodiment of the present invention just described by reference to FIGS. 8–12, the taper of each portion is established by the amount of draft that may be taken in rolling a slab 6 of the same dimensions in consecutive flat passes and those relationships can be calculated by well-known formulae. Further, the opening of the roll gap is synchronized with the advance of the material being rolled by well-known means.

As discussed above, the practice of the method of the present invention involves the consecutive feeding of segments of thin slab 6 into mill stand 27 to be rolled. The length of those segments may be determined by reference to FIG. 8 and the formulae:

$$s_o = s*h/H_1 \text{ [ft.]} \quad (1)$$

$$s_1 = s*h/h_1 \text{ [ft.]} \quad (2)$$

$$s_2 = s*h/h_2 \text{ [ft.]} \quad (3)$$

wherein:

H=initial slab thickness (in.)

s=exit strip length (in.)

h=exit strip thickness (in.)

$h_1$, $h_2$=average thicknesses of the segments $s_1$ and $s_2$ (in.)

The total length rolled during a complete forward pass may be determined by the formula:

$$s_D = s*h*A \text{ [ft.]} \quad (4)$$

wherein:

$$A = 1/H_1 + 1/h_1 + 1/h_2 \text{ [in.}^{-1}\text{]}.$$

Figure 12:
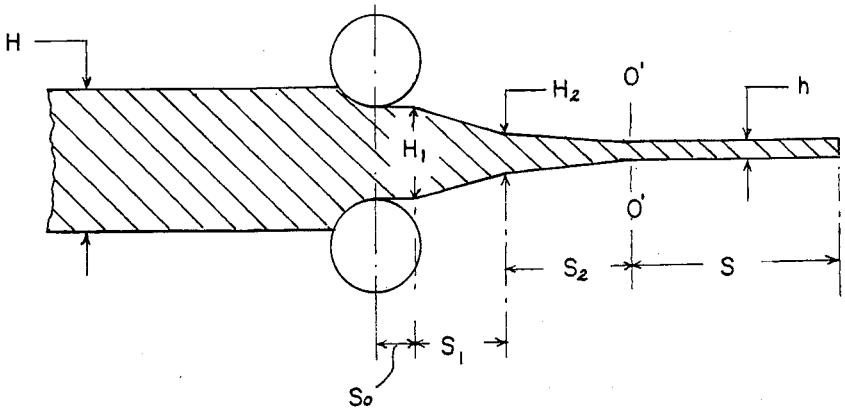
Figure 13:
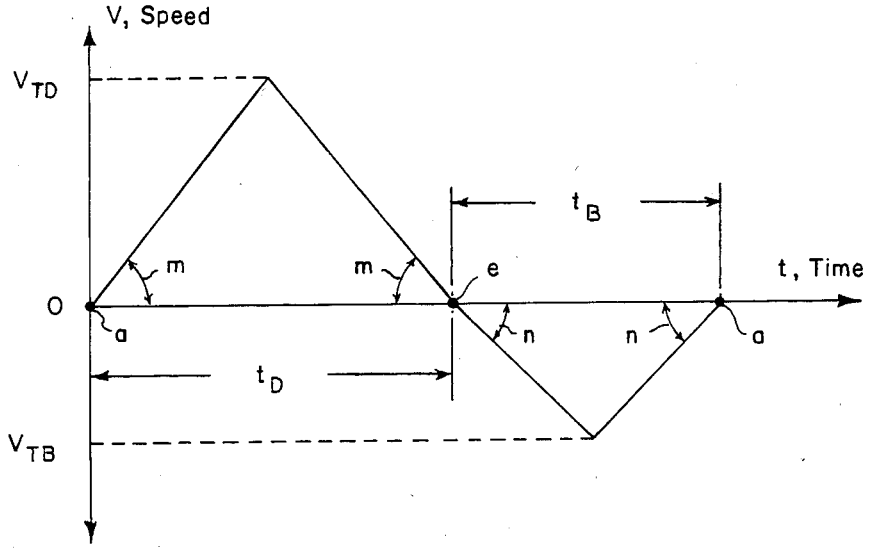
FIG. 13 is a plot of roll speed vs. time for a forward pass and a back pass.

During a forward pass, which includes the sequence depicted in FIGS. 9–12, work rolls 24, 26 are accelerated from zero (as shown in FIG. 8) to a top speed $V_{TD}$ and then are decelerated to zero (in the position depicted in FIG. 12). FIG. 13 is a diagram showing roll speed plotted against time for a forward pass in which acceleration rate and deceleration rate are equal. In such case, the time for completing a forward pass may be determined by the formula:

$$t_D = 2*(60*s_D/m)^{0.5} \text{ [sec.]} \quad (5)$$

wherein:

m=acceleration/deceleration rate (fpm/sec) during a forward pass.

The top speed during a forward pass is:

$$V_{TD} = m*t_D/2 \text{ [fpm].} \quad (6)$$

During a reverse back pass, segments $s_0$, $s_1$ and $s_2$ are retracted to place section 0'—0' (see FIG. 12) in the roll bite. The length of the back pass may be determined by the formula:

$$s_B = s*h*B \text{ [ft.]} \quad (7)$$

wherein:

$$B = (1/H_1 + 1/h_1 + 1/h_2) \text{ [in.}^{-1}\text{]} \quad (8)$$

During a back pass in which the rolls are reversed, work rolls 24, 26 are accelerated from zero (at the position shown in FIG. 12) to a top speed and then are decelerated to zero (at the position shown in FIG. 8). For the case shown in FIG. 13, wherein acceleration and deceleration rates are equal, the time required to complete the back pass may be determined by the formula:

$$t_B = 2*(60*s_B/n)^{0.5} \text{ [sec.].} \quad (9)$$

wherein:

n=acceleration/deceleration rate [fpm/sec] during the back pass.

Top speed during the back pass is:

$$V_{TB} = n*t_B/2 \text{ [fpm]} \quad (10)$$

The time to complete one cycle (forward pass and back pass) may be determined by the formula:

$$t_c = 60*s/V_E \text{ [sec.]} \quad (11)$$

$V_E$=average exit speed of the strip [fpm]

Based on the foregoing, the relationship between the length s of the exit strip at thickness h, which is rolled during each cycle, and the average exit speed $V_E$ may be expressed as follows:

$$s=V_E^2*((A/m)^{0.5}+(B/n)^{0.5})^2*h/15\ [ft.] \quad (12)$$

Figure 14:
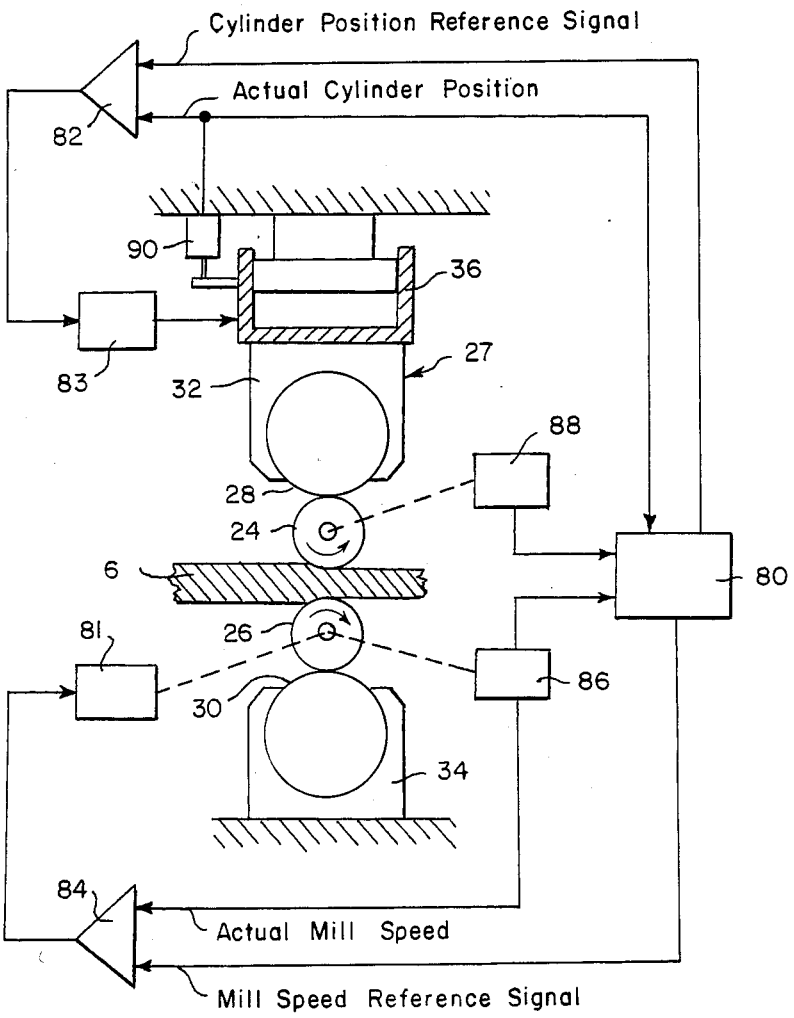
FIG. 14 is a diagram of a control system for a mill stand suitable for use with the present invention.

In certain phases of the practice of the present invention, the opening and closing of the roll gap is synchronized with the angular position and speed of the work rolls. The control system for accomplishing this synchronization may be composed of well-known components; one such system is shown in FIG. 14. A microprocessor 80 stores the required pattern of coordinated movements of cylinder 36, which is actuated by servovalve 83 to open and close the gap between work rolls 24, 26, as a function of angular position and speed of those rolls which are driven by mill drive 81. Based on that pattern, microprocessor 80 generates reference signals for cylinder position regulator 82 and mill drive speed regulator 84.

The actual mill speed is sensed by mill drive speed transducer 86 whose signal is fed back to mill drive speed regulator 84 and microprocessor 80. The actual angular position of the work rolls is sensed by mill drive position transducer 88 whose signal is fed back to microprocessor 80. The actual cylinder position is sensed by cylinder position transducer 90 whose signal is fed back to cylinder position regulator 82 and microprocessor 80. The closing of these control loops permits the desired synchronization of roll gap with work roll speed and angular position.

During a forward pass in the practice of the present invention, the roll gap opening is:

$$h_D=H_1-h\ [in.] \quad (13)$$

The average roll gap opening speed may be determined by the formula:

$$V_D=h_D/t_D\ [in./sec.] \quad (14)$$

During a back pass, the roll gap closing is:

$$h_B=H_1-h=h_D\ [in.] \quad (15)$$

the average roll gap closing speed may be determined by the formula:

$$V_B=h_B/t_B=h_D/t_B\ [in./sec.] \quad (16)$$

Figure 15:
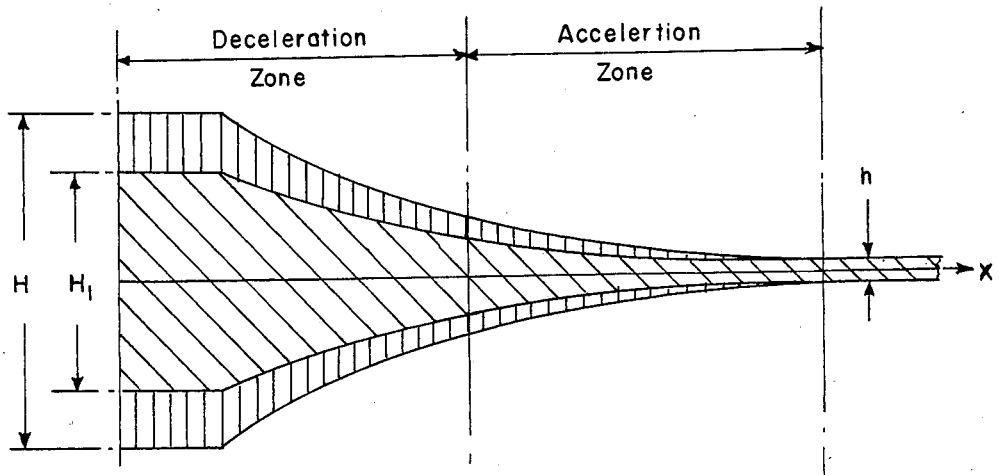
FIGS. 15–19 are a series of diagrams illustrating torque and velocity considerations in the practice of the present invention.
Figure 16:
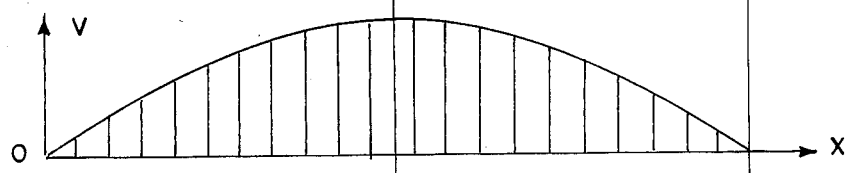
Figure 17:
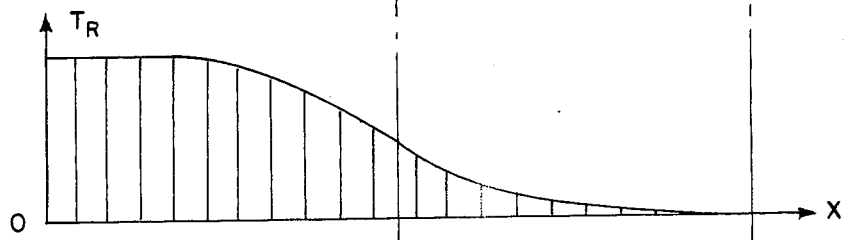
Figure 18:
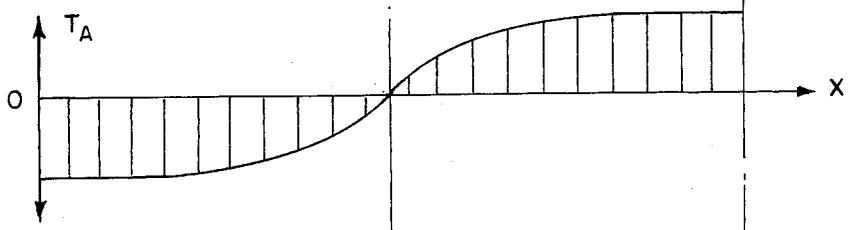
Figure 19:
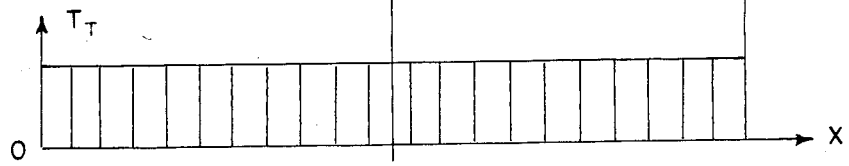

Referring to FIGS. 15–19, first to FIG. 15, there is shown the draft taken on a thin slab during a forward pass of the type described above by reference to FIGS. 8–12. As the pass proceeds, it may be seen that the amount of metal affected increases and this will result in a proportional increase in torque. FIG. 16 illustrates the selection of a mill speed wherein the speed smoothly increases to a maximum and smoothly decreases to zero during the pass. Under such conditions, rolling torque will be as illustrated in FIG. 17; because rolling torque is at a maximum at the end of a forward pass, deceleration and stopping of the mill is aided. Also, with the velocity profile selected, the acceleration/deceleration torque curve will be symmetrical as shown in FIG. 18. The sum of the torque curves shown in FIG. 19 shows a constant value of total torque experienced by the rolling mill during a forward pass. This, of course, is an ideal condition because the load on the mill is constant.

The foregoing principles may be applied to the following Example:

EXAMPLE 1

A continuous thin slab caster issues a thin slab having a thickness of 1.25 in. at a rate of 12 fpm. The thin slab is to be rolled to strip having thickness (h) of 0.10 in. The intermediate thicknesses during rolling are: $H_1$=0.45 in. and $H_2$=0.18 in. The average exit speed of the mill is 150 fpm; the acceleration/deceleration (m, n) rates are equal and have the value 400 fpm/sec. From the above formulae, the following lengths may be determined:

s=25.8 ft.
$s_D$=58.2 ft.
$s_B$=32.3 ft.

The top speeds achieved during rolling are:

$V_{TD}$=1180 fpm
$V_{TB}$ 880 fpm.

These speeds are easily achievable by conventional rolling mills. Further, an average exit speed of 150 fpm would allow the mass flow through the mill to be matched with that supplied by a thin slab caster (i.e., 1.25*12=150*0.1).

Figure 20:
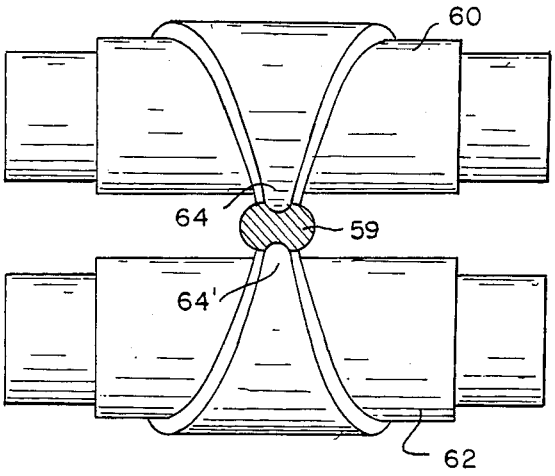
FIGS. 20–23 are a series of diagrams illustrating the rolling of a round to strip using the method of the present invention.
Figure 21:
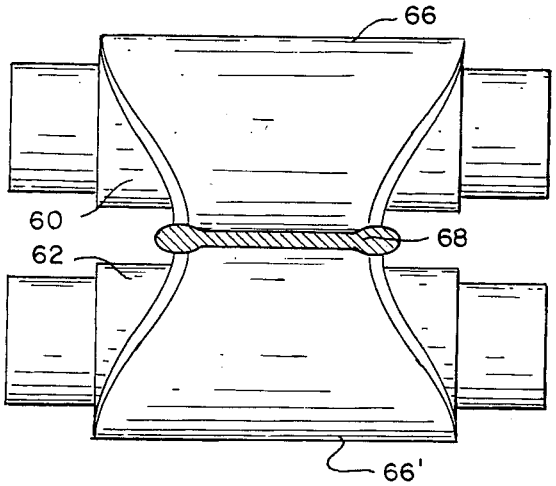
Figure 22:
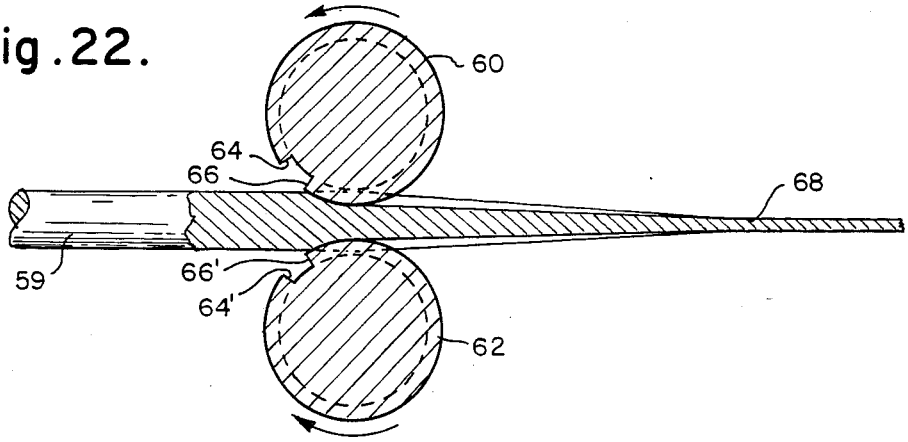
Figure 23:
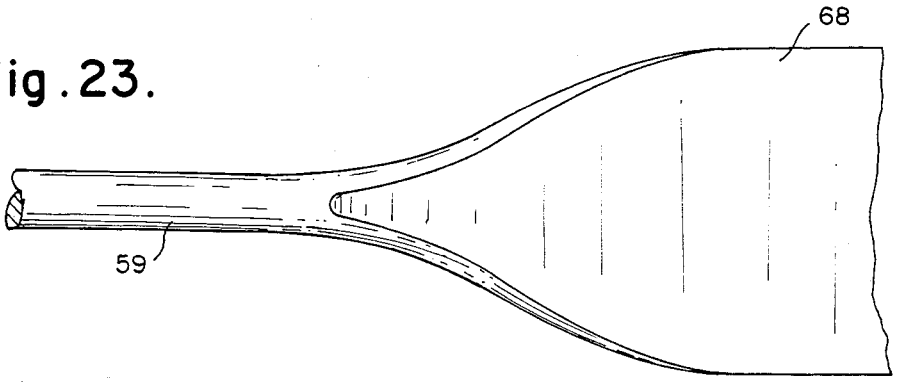

Another embodiment of the present invention will be described by reference to FIGS. 20–23. In this embodiment, the material being hot rolled to strip by the method of the present invention is a continuously cast billet 59 with a cylindrical, oval or multangular shape. An advantage of using billets is that radiation heat losses are minimized with that shape and such losses are an important consideration when rolling is conducted at relatively slow speeds Further, because the rolling of billets to strip involves both longitudinal and transverse elongation, the occurrence of anistropy in the finished strip is reduced. As shown in FIGS. 20–22, the work rolls 60, 62 have complementary, diverging work surfaces, each beginning with a narrow region 64, 64' at the midpoint of the roll and diverging to a wider region 66, 66' extending across the width of the roll. Initially, billet 59 is brought into the roll bite where first contact is made by narrow regions 64, 64'. As the forward pass proceeds, the work surfaces in contact with round 59 become progressively wider; the result is a flattening and spreading of the rolled material, best shown in FIGS. 22–23. When wider regions 66, 66' come into contact with the material (as seen in FIG. 22), the roll gap is relieved and the rolled material is partially retracted in a back pass. The roll gap is again closed and the narrow region again contact the material to further the flattening and spreading, eventually to produce strip 68 (see FIGS. 22, 23).

In this embodiment, the angular position of the diverging work surfaces of the work rolls must be carefully controlled. Further, as best shown in FIGS. 20 and 21, as each coordinated revolution of work rolls 60, 62 proceeds, the roll gap is closed to maintain reduction of the spreading material. As more draft is taken, more torque is required and the mill tends to slow its rotation. Accordingly, control of the speed of rotation of the work rolls 60, 62 during each revolution is necessary.

What is claimed is:

1. A method for rolling in a rolling mill an elongated metal product to form strip comprising the steps of:

(a) subjecting a first segment of predetermined length of said metal product, said length being substantially less than the total length of said elongated slab, to a reduction pass in a first direction wherein said first segment is passed from the entry side to the delivery side of said mill, between a pair of work rolls, said reduction pass having a first phase in which a leading portion of said first segment is rolled to finish thickness and a second phase in which a trailing portion of said first segment is rolled to a thickness greater than finish thickness;

(b) disengaging said work rolls from said first segment and then reversing the direction of movement of said first segment to bring the leading edge of said trailing portion to the entry side of said mill while accommodating the additional length of said trailing portion produced by said reduction pass;

(c) repeating step (a) with respect to said trailing portion and a next contiguous predetermined length of said elongated metal product which together form a second segment;

(d) repeating step (b) with respect to said second segment; and (e) repeating steps (a) and (b) in sequence with respect to consecutive segments of said elongated metal product formed in accordance with step (c).

2. A method as recited in claim 1 wherein:

said elongated metal product is a thin slab.

3. A method as recited in claim 1 wherein:

said elongated metal product is a billet.

4. A method as recited in claim 1 wherein:

said elongated metal product has a curved cross section.

5. A method as recited in either claim 3 or claim 4 wherein:

said rolling of said trailing portion of each segment is accompanied by both longitudinal and transverse spreading of metal.

6. A method of producing a continuous elongated metal strip-like product by an in-line casting and rolling process comprising the steps of:

(a) in a casting machine, producing a continuous elongated metal strip like product having a thickness greater than a desired thickness, said cast product having a desired exit speed and a continuous movement away from said machine;

(b) hot rolling said cast product in a rolling mill while said product is moving away from said casting machine by reducing only a first predetermined length of the cast product to a thickness greater than said desired thickness, said length being less than the total length of the cast product;

(c) after said predetermined length is rolled and while the portion of the cast product between said casting machine and said rolling mill continues to move towards said mill, causing said rolled length to be positioned at the entry side of said rolling mill;

(d) during said repositioned step, looping said product between said casting machine and said mill in a manner to prevent interruption of the continuous issuance of cast product from said casting machine;

(e) causing said partially reduced length to reenter the rolling mill together with the next contiguous predetermined length of said cast product and performing a further reduction on said first predetermined length and a first reduction of said next predetermined length; and thereafter (f) repeating in sequence steps (c), (d) and (e) as to each next predetermined length of said cast product.

7. Apparatus for the production of an elongated metal strip-like product comprising:

a continuous casting machine for producing and issuing an elongated slab having a thickness greater than the desired thickness of said strip-like product;

a rolling mill stand having a pair of work rolls for reducing the product when passed from the entry side to the delivery side of said stand;

means for feeding said slab issuing from said casting machine to the entry side of said rolling mill stand to effect a reduction of only a portion of the total length of the product;

means for disengaging the work rolls from the product after said reduction;

means for intermittently positioning predetermined, partially rolled lengths of said slab on the entry side of said rolling mill stand for further rolling, thereby producing an additional length of slab between said casting machine and said rolling mill stand; and means disposed between said casting machine and said rolling mill stand for selectively looping said slab from its normal path to accommodate said additional length and thereby to prevent interruption of the issuance of said slab from said casting machine.

8. Apparatus for the production of an elongated metal strip-like product from a billet-like workpiece comprising:

a rolling mill stand having a pair of work rolls for reducing the workpiece when passed from the entry side to the delivery side of said stand to effect a reduction of only a portion of the total length of the workpiece;

means for disengaging the work rolls from the workpiece after said reduction;

means for intermittently positioning predetermined, partially rolled lengths of said workpiece on the entry side of said rolling mill stand;

said pair of work rolls having complementary workpiece contact surfaces, each of said surfaces including a narrow central portion smoothly diverging around the circumference of said work roll to a wider portion approximating the desired width of said strip-like product; and means operatively connected to said work rolls to control their speed and the gap therebetween.

9. A method for the production of elongated strip-like product from a billet-like workpiece by a rolling mill having a pair of work rolls for reducing the workpiece comprising the steps of:

(a) subjecting a first segment of predetermined length of said workpiece, said length being substantially less than the total length of said workpiece, to a reduction pass in a first direction wherein said first segment is passed from the entry side to the delivery side of said mill through said pair of work rolls, said work rolls having complementary surfaces which spread the metal of said workpiece both longitudinally and transversely, thereby rolling a portion of said predetermined length to finish thickness;

(b) disengaging said work rolls from said first segment and then reversing the direction of movement of said first segment to bring the leading edge of that portion of the workpiece not rolled to finish thickness in the just-completed reduction pass to the entry side of said work rolls; and (c) repeating step (a) with respect to said portion of unfinished thickness and a next contiguous predetermined length of said workpiece.

* * * * *

UNITED STATES PATENT AND TRADEMARK OFFICE

CERTIFICATE OF CORRECTION

PATENT NO. : 4,793,169

DATED : December 27, 1988

INVENTOR(S) : VLADIMIR B. GINZBURG

It is certified that error appears in the above-identified patent and that said Letters Patent is hereby corrected as shown below:

In REFERENCES CITED, U. S. Patent Documents, delete "3,385,077" and substitute therefor --3,485,077--

Col. 1, line 31, after "stands," insert -- workers devised methods for continuously casting a thin slab--

Col. 3, line 21, before "used", insert -- passes--

Col. 5, line 19, delete "0'0", and susbtitute therefor --0-0),--

Col. 8, line 35, after "speeds,", insert --.--

Signed and Sealed this

Seventeenth Day of October, 1989

*Attest:*

DONALD J. QUIGG

*Attesting Officer*

*Commissioner of Patents and Trademarks*